US008584326B2

(12) United States Patent
Keyaki et al.

(10) Patent No.: US 8,584,326 B2
(45) Date of Patent: Nov. 19, 2013

(54) SLIDER FOR SLIDE FASTENER

(75) Inventors: Keiichi Keyaki, Toyama (JP); Koji Yamagishi, Toyama (JP); Takanori Ozawa, Toyama (JP)

(73) Assignee: YKK Corporation (JP)

( * ) Notice: Subject to any disclaimer, the term of this patent is extended or adjusted under 35 U.S.C. 154(b) by 147 days.

(21) Appl. No.: 13/126,048

(22) PCT Filed: Dec. 17, 2008

(86) PCT No.: PCT/JP2008/072953

§ 371 (c)(1),
(2), (4) Date: Apr. 26, 2011

(87) PCT Pub. No.: WO2010/070744

PCT Pub. Date: Jun. 24, 2010

(65) Prior Publication Data

US 2011/0197403 A1 Aug. 18, 2011

(51) Int. Cl.
*A44B 19/30* (2006.01)

(52) U.S. Cl.
USPC ..... 24/421; 24/420

(58) Field of Classification Search
USPC ..... 24/418–421, 423, 424
See application file for complete search history.

(56) References Cited

U.S. PATENT DOCUMENTS 2,737,699 A * 3/1956 Erdmann ..... 24/421
2,989,792 A 6/1961 Huelster
3,038,226 A 6/1962 Kedzierski
3,262,172 A * 7/1966 Scheuerman ..... 24/421
3,287,780 A * 11/1966 Cooperberg ..... 24/421
4,069,556 A * 1/1978 Takahashi ..... 24/421
4,139,928 A 2/1979 Aoki et al.
4,391,022 A 7/1983 Oda
6,588,072 B1 * 7/2003 Lin ..... 24/421
6,647,598 B2 11/2003 Lin

FOREIGN PATENT DOCUMENTS

GB 1201522 A 8/1970
JP 175486 C 10/1924
JP 130410 A 10/1981

OTHER PUBLICATIONS

International Search Report and Written Opinion, PCT International Patent Application No. PCT/JP2008/072953, mailed Mar. 31, 2009.

* cited by examiner

*Primary Examiner* — Robert J Sandy
*Assistant Examiner* — Abigail E Morrell
(74) *Attorney, Agent, or Firm* — Kilpatrick Townsend & Stockton LLP

(57) ABSTRACT

A slider has an upper blade of a slider body having an insert groove of a locking pawl, a temporary engagement portion which temporary engages and fixes the locking pawl, and a claw hole. The temporary engagement portion is adapted so that, with the locking pawl fixed in position, the position in height of the upper end of the temporary engagement portion is the same as or lower than that of the upper surface of the upper blade. This prevents the temporary engagement portion from being pressed and crushed when the temporary engagement portion is in contact with the tab and so on. As a result, an automatic stop mechanism of the slider can stably function.

6 Claims, 10 Drawing Sheets

SLIDER FOR SLIDE FASTENER

This application is a national stage application of PCT/JP2008/072953, which is incorporated herein by reference.

TECHNICAL FIELD

The invention relates to a slider for a slide fastener having an automatic locking mechanism using a locking pawl, and more particularly, to a slider for a slide fastener capable of protecting operations of a locking pawl so that a sliding property or an automatic locking mechanism can be stably maintained for a long time.

BACKGROUND ART

Conventionally, as a slider used for a slide fastener, there has been known a slider with an automatic locking mechanism, where if a tab is released from manipulation after the opening and closing of the slide fastener, a locking pawl disposed in the slider automatically makes an action to maintain a locked position of the slider, and if the tab is not manipulated, the slider can be maintained in a sliding locked state. In addition, specific examples of the slider with the automatic locking mechanism are disclosed in, for example, U.S. Pat. No. 6,647,598 (Patent Document 1) or British Patent No. 1201522 (Patent Document 2).

For example, in the slider 80 disclosed in Patent Document 1 as illustrated in FIGS. 13 and 14, an upper blade 82 is provided with an insert groove 83 into which the locking pawl 96 is inserted, a claw hole 85 which is formed near the edge of the rear-opening-side end of the upper blade 82 so as to start from the upper surface side of the upper blade 82 and to pass through an element guide lane 84, protrusions 86 for temporary engagement which are disposed upwardly on the left and right sides of the insert groove 83 in the front end portion of the upper blade 82, and left and right tab retaining portions 87 for retaining a tab 91.

In addition, in the locking pawl 96 disclosed in Patent Document 1, a claw portion 97 which passes through the claw hole 85 of the slider body 81 is disposed in the one end portion of the locking pawl 96, a hook portion 98 which is inserted into the insert groove 83 of the slider body 81 is disposed in the other end portion of the locking pawl 96, and a cover portion 99 which covers a connection rod 94 of the tab 91 is disposed between the claw portion 97 and the hook portion 98.

In addition, the tab 91 disclosed in Patent Document 1 includes a tab body 92, left and right arms 93 which are disposed to extend from the tab body 92, and the cylindrical connection rod 94 which connects the front end portions of the left and right arms 93. In addition, a concave portion 95 having a semi-circular shape in the cross section of the connection rod 94 is formed at the left-right-directional center of the connection rod 94.

In addition, in Patent Document 1, in the case where the aforementioned tab 91 and locking pawl 96 are assembled with the slider body 81, first, the connection rod 94 of the tab 91 is inserted into the tab retaining portion 87 of the slider body 81, and the tab retaining portion 87 is temporarily engaged, so that the tab 91 is rotatably retained in the slider body 81. Subsequently, the locking pawl 96 is inserted into the insert groove 83 of the slider body 81 where the tab 91 is retained, by performing position alignment so that the claw portion 97 of the locking pawl 96 passes through the claw hole 85 of the slider body 81. Therefore, the locking pawl 96 is disposed at a predetermined position of the slider body 81.

After that, the protrusion 86 of the slider body 81 is temporarily engaged, so that the other end portion of the locking pawl 96 is temporarily engaged and fixed with a predetermined clearance. As a result, the slider 80 disclosed in Patent Document 1 illustrated in FIG. 14 can be assembled. In addition, in FIG. 14, for clearly illustrating the assembled state of the slider 80, the tab 91 is drawn by a virtual line.

In this manner, in the assembled slider 80 disclosed in Patent Document 1, as illustrated in FIG. 14, in the state where the tab 91 collapses down toward the rear opening side, since the cover portion 99 of the locking pawl 96 is inserted into the concave portion 95 of the tab 91 and the relative position of the locking pawl 96 with respect to the slider body 81 is lowered, so that the claw portion 97 of the locking pawl 96 is inserted (protruded) from the claw hole 85 of the slider body 81 into the element guide lane 84.

On the other hand, in the case where the tab 91 is allowed to be erected or collapse toward the front end side of the slider 80, since the cover portion 99 of the locking pawl 96 is detached from the concave portion 95 to be lifted up by the connection rod 94 of the rotating tab 91, the claw portion 97 of the locking pawl 96 is detached from the element guide lane 84. In this case, as described above, the other end portion of the locking pawl 96 is fixed with a predetermined clearance. Therefore, when performing the falling and erecting manipulations for the tab 91, the other end portion of the locking pawl 96 can be moved into the insert groove 83 by using the clearance. Accordingly, it is possible to smoothly perform the inserting and detaching operations of the claw portion 97 with respect to the element guide lane 84.

Accordingly, when the slide fastener is configured by using the slider 80, for example, in the case where the tab 91 is fallen down to the side of the rear opening by releasing the manipulation for the tab 91, the claw portion 97 of the locking pawl 96 can be allowed to protrude toward the element guide lane 84 so as to be engaged with the element rows. Therefore, the slider 80 is locked with respect to the element rows, so that the locked position can be maintained. On the other hand, in the case where the tab 91 is allowed to be erected in order to manipulate the slider 80, the claw portion 97 is detached from the element guide lane 84, so that the engagement between the claw portion 97 and the element rows is released. Therefore, it is possible to smoothly slide the slider 80 along the element rows.

In addition, similarly to the slider disclosed in Patent Document 1, the slider disclosed in Patent Document 2 also includes a slider body, a locking pawl which is disposed to an upper blade of the slider body, and a tab whose one end is rotatably retained in the upper blade.

In this case, the upper blade of the slider body is provided with an insert groove into which the locking pawl is inserted, a claw hole which is penetrated in a rear-opening-side end edge of the upper blade so as to pass through an element guide lane from the upper surface side of the upper blade, and left and right tab retaining portions which retain a connection rod of the tab.

In addition, in the slider body, the aforementioned protrusion where the locking pawl is temporarily engaged and fixed as disclosed in Patent Document 1 is not provided, and in order to fix the other end portion of locking pawl with a predetermined clearance, a fixing portion, which traverses the insert groove so as to construct a bridge, is fixed on the upper surface of the upper blade.

The tab disclosed in Patent Document 2 includes a cam for lifting up the locking pawl at the time of erecting the tab with respect to the slider body in a central portion of the cylindrical connection rod which connects the left and right arms.

In the case where the slide fastener is configured by using the slider disclosed in Patent Document 2, similarly to the case of Patent Document 1, by allowing the tab to be fallen down to the side of the rear opening, the claw portion of the locking pawl is engaged with the element rows, so that the locked position of slider can be maintained. In addition, by allowing the tab to be erected, the claw portion is detached from the element guide lane, so that the slider can be smoothly slid.

Patent Document 1: U.S. Pat. No. 6,647,598

Patent Document 2: British Patent No. 1201522

DISCLOSURE OF THE INVENTION

Problems to be Solved by the Invention

In the slider disclosed in Patent Document 1 or Patent Document 2, as described above, the temporary-engagement protrusion 86 or the fixing portion is disposed so as to fix the locking pawl 96 to the front end portion of the slider body 81. Therefore, after the locking pawl 96 is inserted the insert groove 83 of the upper blade 82, the temporary engagement is performed by using the temporary engagement portion, or the fixing portion is fixed to a predetermined position of the upper blade 82, so that the locking pawl 96 can be fixed the upper blade 82 of the slider body 81 so that the claw portion 97 of the locking pawl 96 can be inserted into and detached from the element guide lane 84.

However, in this manner, in the case where the locking pawl 96 is fixed on the upper blade 82 of the slider body 81, the temporary-engagement protrusion 86 or the fixing portion for fixing the locking pawl 96 becomes in the state of rising from the upper surface of the upper blade 82 of the slider body 81 (refer to FIG. 14). In this case, at the time of using the slider 80, the tab 91 is allowed to be fallen down to the front end side, so that the tab may collide with the temporary-engagement protrusion 86 or the fixing portion, or the temporary-engagement protrusion 86 or the fixing portion may contact with the other members. As a result, the temporary-engagement protrusion 86 or the fixing portion is pressed by an external force, so that a size of clearance provided at the time of fixing the other end portion of the locking pawl 96 cannot be stably maintained.

In this manner, if a sufficient clearance cannot be secured at the side of the other end portion of the locking pawl 96, the motion (movement) of the locking pawl 96 in the insert groove 83 is limited, so that the inserting and detaching operations of the claw portion 97 with respect to the element guide lane 84 cannot be smoothly performed. As a result, there is a problem in that, the sliding property of the slider 80 is deteriorated, and the automatic locking mechanism cannot correctly function.

By taking into consideration the conventional problems, the invention is to provide a slider for a slide fastener capable of smoothly performing inserting and detaching operations of a claw portion with respect to an element guide lane without limitation of movement of a locking pawl at the time of using the slider, so that a sliding property of the slider or an automatic locking mechanism can be stably maintained for a long time.

Solutions to the Problems

In order to achieve the above object, a slider for a slide fastener provided by the invention includes: a slider body, in which front end portions of upper and lower blades are connected to each other by a connection post and a Y-shaped element guide lane is disposed between the upper and lower blades; a tab whose one end portion is rotatably retained in the upper blade; and a locking pawl which is disposed in the upper blade and whose one end is provided with a claw portion, wherein the upper blade includes: an insert groove into which the locking pawl is inserted; a temporary engagement portion which fixes an other end portion of the locking pawl; a claw hole which is penetrated so as to pass through the claw portion; and the locking pawl is disposed so that the claw portion can be inserted into and detached from the element guide lane through the claw hole by falling and erecting operations of the tab, being most mainly characterized in that in a state where the locking pawl is fixed, the temporary engagement portion is disposed so that a height position of an upper end of the temporary engagement portion is equal to that of an upper surface of the upper blade or lower than that of the upper surface.

In the slider for the slide fastener according to the invention, it is preferable that a concave insert portion is disposed in a concave shape on a side of an upper surface of a portion, which is connected to the connection post of the upper blade, with the insert groove interposed therebetween, and the temporary engagement portion is disposed upwardly from a bottom surface portion of the concave insert portion. In this case, a stepped portion which is formed at a height position between the upper surface of the upper blade and the bottom surface portion of the concave insert portion is preferably provided to at least a portion of a circumference of the concave insert portion.

On the other hand, in the slider for the slide fastener according to the invention, the temporary engagement portion may allow the upper blade to be pressed from the upper surface and allow a portion of the upper blade to be plastically deformed, so that the temporary engagement portion is disposed to extend so as to be projected from a side wall of the insert groove toward an inner portion of the insert groove.

Also, in the slider for the slide fastener according to the invention, it is preferable that rising portions which rise from the upper surface of the upper blade are disposed between the temporary engagement portion and the tab retaining portion which rotatably retains the tab. In this case, the rising portions are preferably disposed at left and right sides of the insert groove.

Effects of the Invention

In the slider for the slide fastener according to the invention, the upper blade of the slider body includes an insert groove into which the locking pawl is inserted, a temporary engagement portion which temporarily engages and fixes the other end portion of the locking pawl, and a claw hole which is penetrated so as to pass through the claw portion of the locking pawl; and in the state where the locking pawl is fixed, the temporary engagement portion is disposed so that a height position of the upper end of the temporary engagement portion is equal to that of the upper surface of the upper blade or lower than that of the upper surface.

In the slider according to the invention, since the height position of the upper end of the temporary engagement portion which fixes the locking pawl is equal to that of the upper surface of the upper blade or lower than that of the upper surface, although the tab is fallen down to the front end side of the slider body, the tab does not collide with the temporary engagement portion, and the temporary engagement portion is prevented from contacting with the other members, so that it is possible to prevent the temporary engagement portion from being pressed directly by an external force applied at the time of using the slider.

Therefore, since a size of clearance provided at the time of fixing the other end portion of the locking pawl by the temporary engagement portion can be stably maintained, so that the movement of the locking pawl cannot be limited at the time of using the slider. Accordingly, in the slider, the inserting and detaching operations of the claw portion with respect to the element guide lane are smoothly performed, so that it is possible to stably maintain a sliding property of the slider or an automatic locking mechanism for a long time.

In the slider for the slide fastener according to the invention, a concave insert portion is disposed in a concave shape on a side of an upper surface of a portion, which is connected to the connection post of the upper blade, with the insert groove interposed therebetween, and the temporary engagement portion is disposed upwardly from a bottom surface portion of concave insert portion. Therefore, it is possible to easily set the upper end of the temporary engagement portion which fixes the locking pawl so that the height of the upper end is equal to that of the upper surface of the upper blade or lower than that of the upper surface.

In this case, a stepped portion which is formed at a height position between the upper surface of the upper blade and the bottom surface portion of the concave insert portion is provided to at least a portion of a circumference of the concave insert portion, so that it is possible to stably secure the strength of the mold of molding the slider, and it is possible to easily secure the upward installation height of the temporary engagement portion.

More specifically, as described above, in the case where the temporary engagement portion is disposed upwardly from the bottom surface portion of the concave insert portion, since the slider is generally small, it is difficult to secure a sufficient space between the temporary engagement portion and the side wall of the concave insert portion. Therefore, in a mold for molding the slider body, a thickness of the portion of the mold for molding the temporary engagement portion inevitably becomes thin, and thus, if the thin portion becomes long, a strength of the mold is decreased. Accordingly, in order to secure an appropriate strength of the mold, the length of the thin portion of the mold needs to be shortened. As a result, the upward installation height of the temporary engagement portion may be limited.

However, according to the invention, since the height of the side wall of the concave insert portion is lowered by providing the stepped portion to at least a portion of the circumference of the concave insert portion, the thin portion of the mold disposed between the temporary engagement portion and the side wall of the concave insert portion can be formed to be shorted, so that it is possible to prevent a decrease in the strength of the mold. In addition, in this manner, the strength of the portion of the mold of molding the temporary engagement portion can be stably secured by providing the stepped portion, so that the length of the portion of the mold needs not to be shortened so as to secure the strength of the mold. Therefore, it is possible to easily secure the upward installation height of the temporary engagement portion.

In addition, in the slider for the slide fastener according to the invention, as described above, although the temporary engagement portion is not disposed upwardly from the bottom surface portion of the concave insert portion, the temporary engagement portion allows the upper blade to be pressed from the upper surface and allows a portion of the upper blade to be plastically deformed toward an inner portion of the insert groove, so that the temporary engagement portion may be disposed to extend so as to be projected from the side wall of the insert groove toward an inner portion of the insert groove. Accordingly, it is possible to easily set the upper end of the temporary engagement portion which fixes the locking pawl so that the height of the upper end is equal to that of the upper surface of the upper blade or lower than that of the upper surface.

In addition, in the slider for a slide fastener according to the invention, rising portions which rise from the upper surface of the upper blade are disposed between the temporary engagement portion and the tab retaining portion which retains the tab. Since the rising portions are provided, when the tab is fallen down to the front end side of the slider body, the tab is allowed to contact with the rising portions, so that it is possible to prevent the tab from colliding with the temporary engagement portion.

Particularly, in this case, the rising portions may be disposed at the left and right sides of the insert groove, so that it is possible to more securely prevent the tab from colliding with the temporary engagement portion. In addition, when the locking pawl is shaken upwards and downwards in the insert groove due to the manipulation of the tab, although a portion of the locking pawl is moved up to a position higher than the upper surface of the upper blade, the locking pawl can be hidden so as not to be easily seen from the left and right sides by the rising portions so that the locking pawl is not popped up from an inner portion of the insert groove. Therefore, it is possible to improve outer appearance of the slider.

DESCRIPTION OF REFERENCE SIGNS

Figure 1:
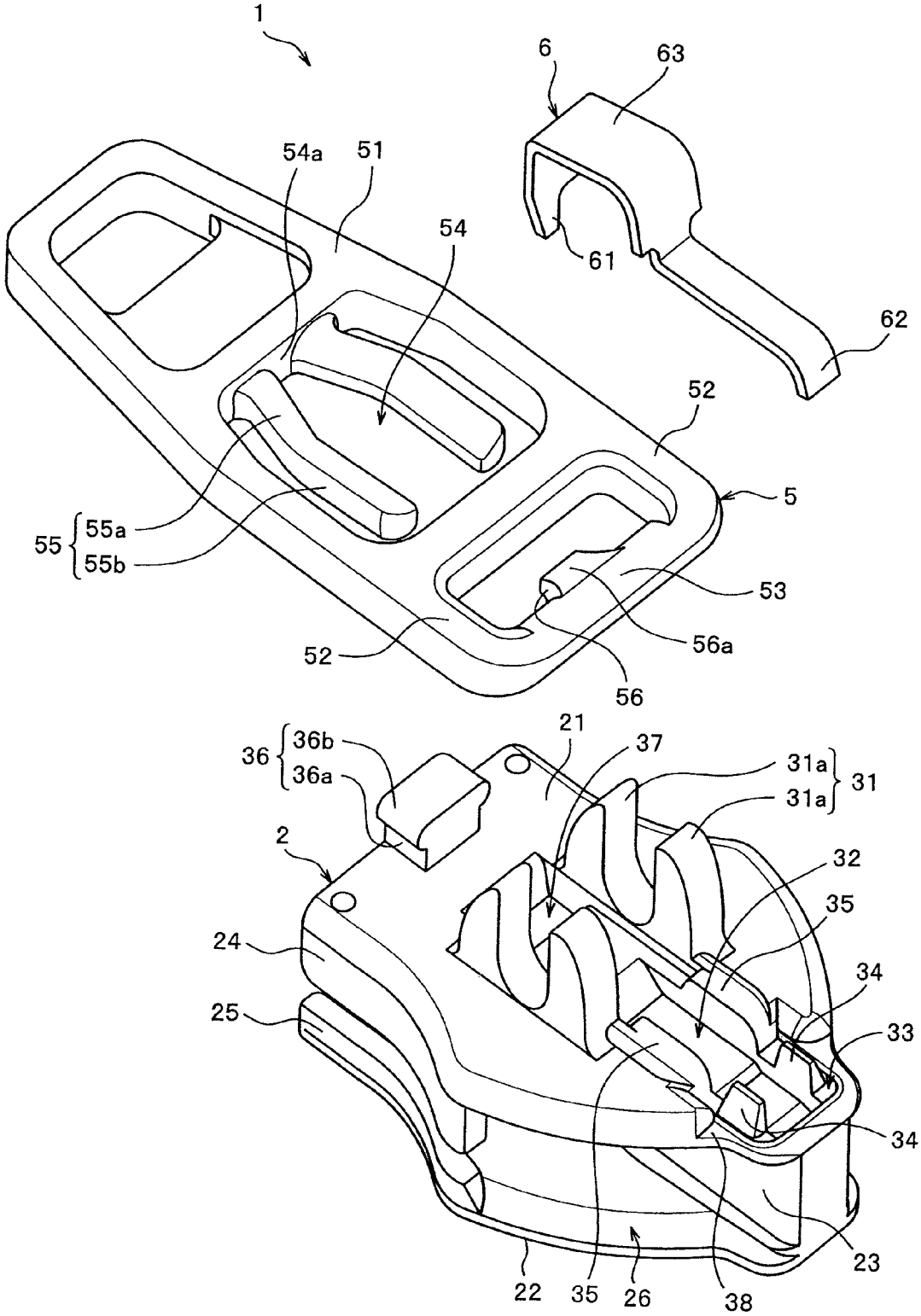
FIG. 1 is a perspective view illustrating a state where parts constituting a slider for a slide fastener according to a first embodiment are separated.

1: slider
2: slider body
5: tab
6: locking pawl
10: mold
10*a*: a portion of mold (thin protrusion)
11: gap
21: upper blade
22: lower blade
23: connection post
24: upper flange portion
25: lower flange portion
26: shoulder opening
27: rear opening
28: element guide lane
31: tab retaining portion
31*a*: tab temporary-engagement protrusion
32: insert groove
33: concave insert portion
34: temporary engagement portion
34*a*: upper end
35: rising portion
36: tab engagement portion
36*a*: neck portion
36*b*: engagement head
37: claw hole
38: stepped portion
51: tab body
52: arm
53: connection rod
54: opening window
54*a*: side wall
55: cantilever engagement piece
55*a*: first engagement piece portion
55*b*: second engagement piece portion
56: cam
56*a*: slant surface
61: claw portion
62: hook portion
63: cover portion
71: slider
72: slider body
74: temporary engagement portion
74*a*: upper end
75: concave portion

BEST MODE FOR CARRYING OUT THE INVENTION

Hereinafter, embodiments of the invention will be described in detail with reference to the drawings.

First Embodiment

Figure 2:
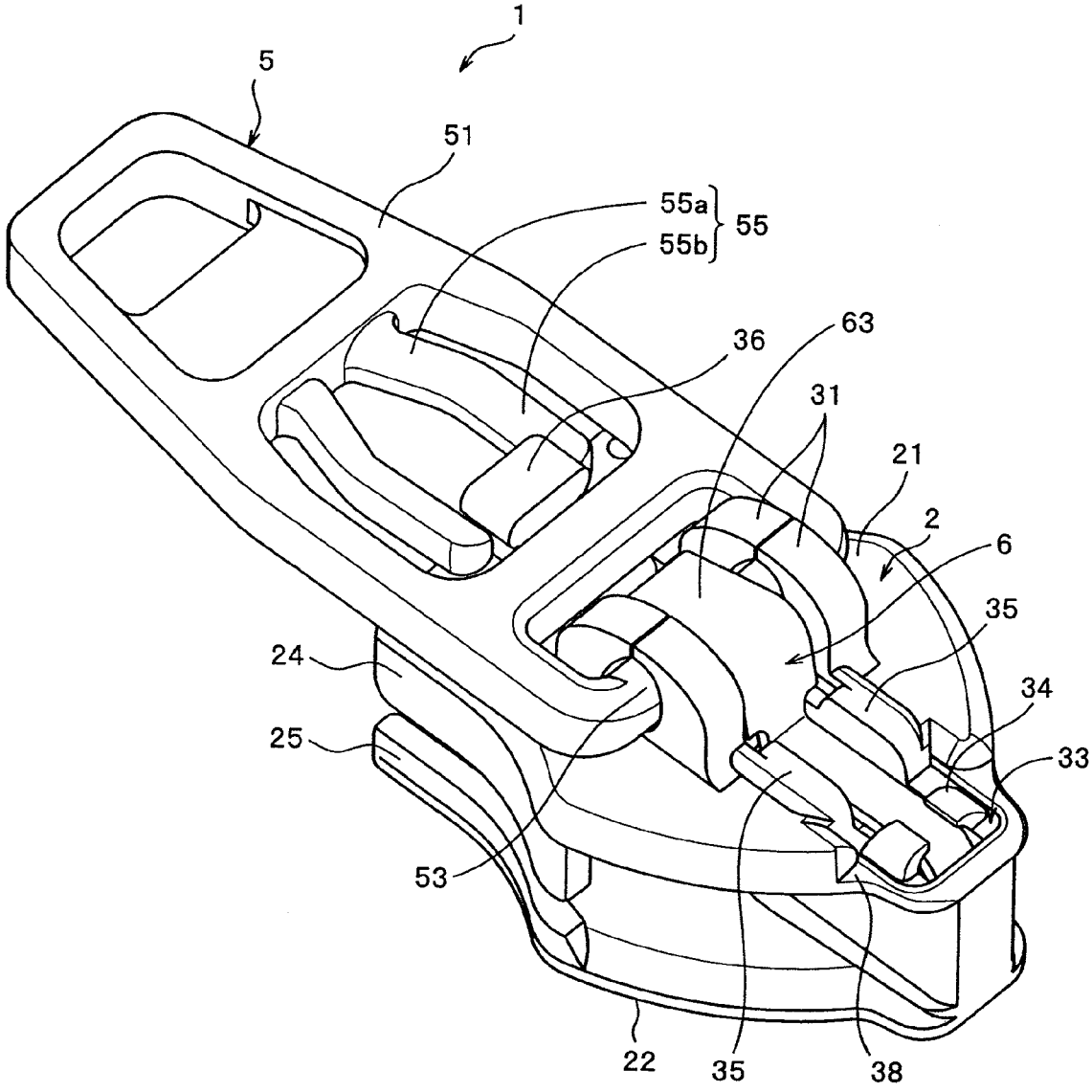
FIG. 2 is a perspective view illustrating a state where the slider is assembled.
Figure 3:
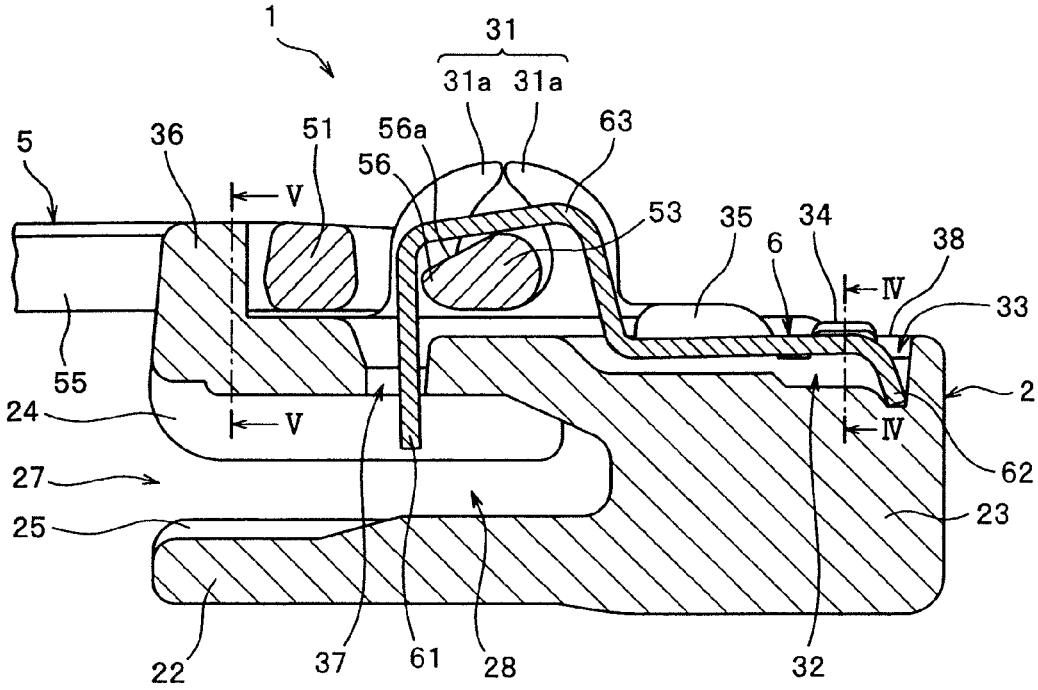
FIG. 3 is a cross-sectional view illustrating a tab is fallen down to a rear opening side in the slider.
Figure 4:
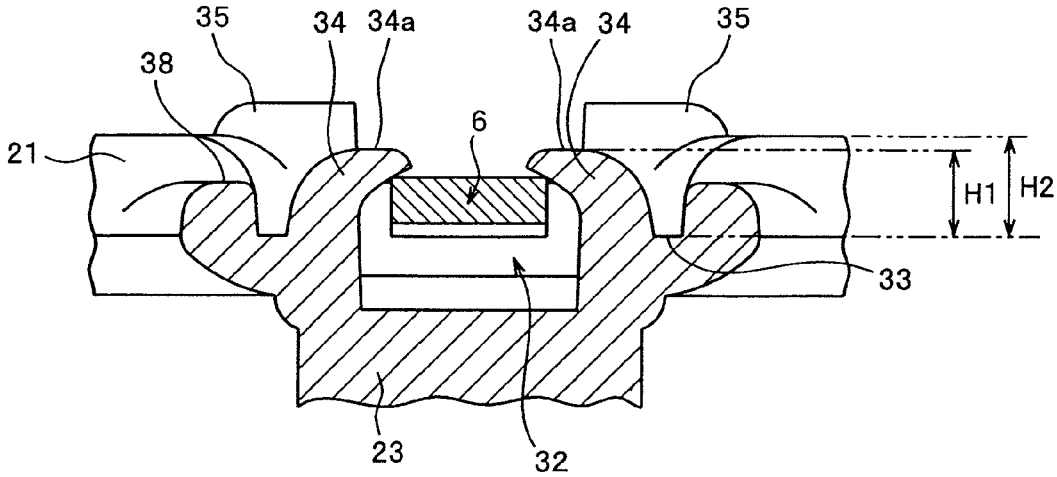
FIG. 4 is a cross-sectional view taken along line IV-IV of FIG. 3.
Figure 5:
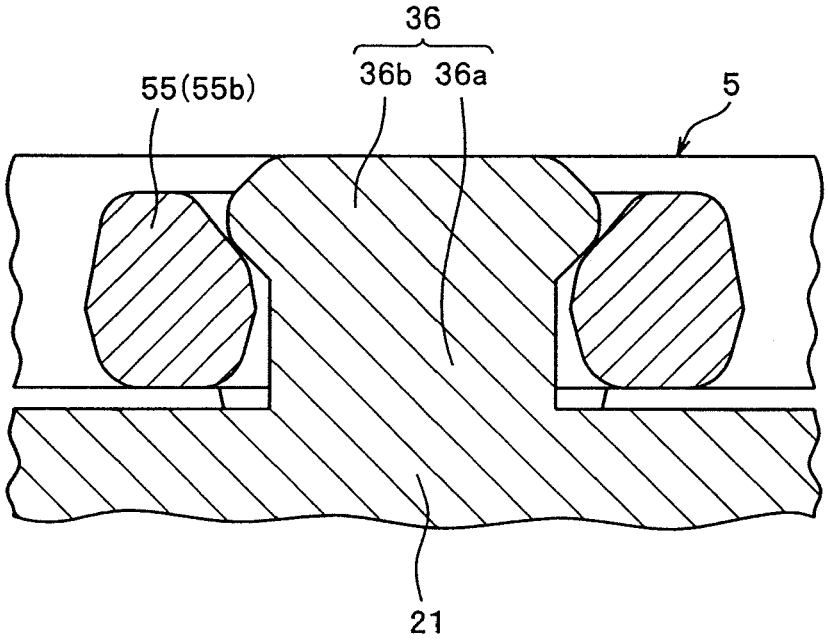
FIG. 5 is a cross-sectional view taken along line V-V of FIG. 3.

FIG. 1 is a perspective view illustrating a state where parts constituting a slider for a slide fastener according to a first embodiment are separated, and FIG. 2 is a perspective view illustrating a state where the slider is assembled. In addition, FIG. 3 is a cross-sectional view illustrating a tab is fallen down to a rear opening side in the slider; FIG. 4 is a cross-sectional view taken along line IV-IV of FIG. 3; and FIG. 5 is a cross-sectional view taken along line V-V of FIG. 3.

In addition, in the slider according to the invention, the direction where the slider is slid so as to couple the element rows is set to the forward direction, and the direction where the slider is slid so as to separate the element rows is defined by the backward direction. In addition, the directions which are perpendicular to the upper and lower blades are defined by the upward and downward directions, and the directions which are parallel to the upper and lower blades and perpendicular to the sliding direction of the slider are defined by the leftward and rightward directions.

As illustrated in FIG. 1, the slider 1 for the slide fastener according to the first embodiment include a the slider body 2, a the tab 5 whose one end portion can be rotatably retained by the slider body 2, and a locking pawl 6 which is disposed to the slider body 2. In the slider 1 according to the first embodiment, the slider body 2 and the tab 5 are manufactured through die-cast molding by using a metal material such as an aluminum alloy or a zinc alloy. In addition, the locking pawl 6 is manufactured through press molding by using a metal material such as a stainless steel or a copper alloy.

As illustrated in FIG. 1, the slider body 2 includes an upper blade 21, a lower blade 22, and a connection post 23 which connects front end portions of the upper and lower blades 21 and 22. In each of the left and right side portions of the upper blade 21, an upper flange portion 24 is disposed downwardly in the direction perpendicular to the upper blade 21, and in each of the left and right side portions of the lower blade 22, a lower flange portion 25 is disposed upwardly in the direction perpendicular to the lower blade 22.

In addition, the slider body 2 includes shoulder openings 26 disposed on the left and right sides of the connection post 23 and a rear opening 27 disposed in the rear end. A Y-shaped element guide lane 28 connecting the left and right shoulder openings 26 and the rear opening 27 is formed between the upper and lower blades 21 and 22.

The upper blade 21 of the slider body 2 includes left and right tab retaining portions 31 which rotatably support one end of the tab 5, an insert groove 32 which is disposed at the left-right-directional center of the upper surface of the upper blade 21, so that the locking pawl 6 is inserted into the insert groove 32, a concave insert portion 33 which is formed in a concave shape in the front end portion of the upper blade 21 with the insert groove 32 interposed therebetween, a pair of the left and right temporary engagement portions 34 which are disposed upwardly from a bottom portion of the concave insert portion 33, rising portions 35 which are disposed between the tab retaining portion 31 and the concave insert portion 33 at the left and right sides of the insert groove 32 and rise from the upper surface of the upper blade 21, and a tab engagement portion 36 which allows the tab 5 to be engaged so that the tab 5 can be detached when the tab 5 is fallen down to the side of the rear opening 27.

The tab retaining portion 31 includes a pair of forward and backward tab temporary-engagement protrusions 31*a* which are disposed to protrude at the left and right sides of the insert groove 32. Therefore, after a later-described connection rod 53 of the tab 5 is inserted between the forward and backward tab temporary-engagement protrusions 31*a*, temporary engagement is performed by bending the pair of forward and backward tab temporary-engagement protrusions 31*a* in the approaching direction, so that the connection rod 53 of the tab 5 can be rotatably retained by the tab retaining portion 31.

The insert groove 32 has a groove width equivalent to the width dimension (left-right-directional dimension) of the locking pawl 6 or a groove width slightly larger than the width dimension so that the locking pawl 6 can be stably inserted into the insert groove 32. In addition, on a bottom surface portion of the insert groove 32, a step difference corresponding to a shape of the locking pawl 6 is disposed in a step shape in the length direction of the insert groove 32. In addition, in the rear end portion of the insert groove 32, a claw hole 37 is disposed to penetrate so that a later-described claw portion 61 of the locking pawl 6 can pass through the claw hole 37 when the locking pawl 6 is disposed inside the insert groove 32.

The concave insert portion 33 is formed in a concave shape at the upper surface side of the portion (that is, the front end portion) where the connection post 23 of the upper blade 21 is connected. In the first embodiment, since the insert groove 32 is disposed to extend in the forward and backward directions at the left-right-directional center of the concave insert portion 33, the concave insert portion 33 is disposed so as to be divided into left and right portions so that the insert groove 32 is interposed therebetween.

In addition, a stepped portion 38 is formed in the portion surrounding the front half portion of the concave insert portion 33. The stepped portion 38 has a stepped plane at the height position between the upper surface of the upper blade 21 and the bottom surface portion of the concave insert portion 33.

Now, advantages obtained from the configuration of the stepped portion 38 are described with reference to FIG. 6.

Figure 6:
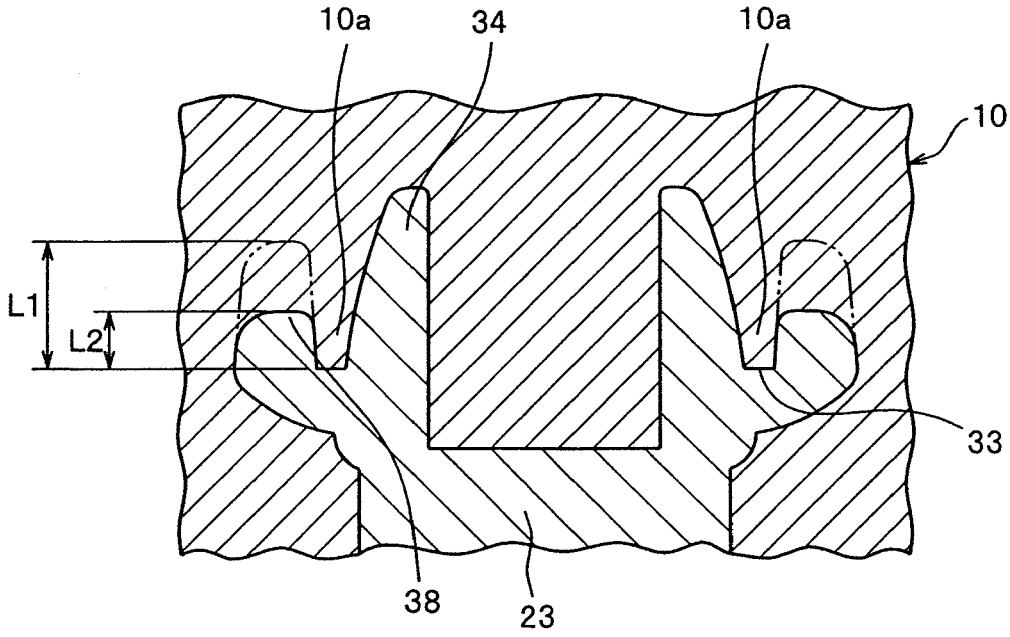
FIG. 6 is a view for explaining a mold for molding a slider body.

In the case where the slider 1 according to the first embodiment is formed by using die-cast molding, a mold 10 illustrated in FIG. 6 is used. The mold 10 has a cavity corresponding to a shape of the slider 1. In this case, in the case where a slider which does not have the stepped portion 38 according to the first embodiment is molded (the case of the virtual line illustrated in FIG. 6), in order to form the cavity for molding the temporary engagement portions 34 having a predetermined height, a portion 10*a* of the mold needs to protrude by a dimension L1 in height.

However, in this case, since dimension of the slider 1 is small, it is difficult to secure a sufficient space between the temporary engagement portions 34 and the side wall of the concave insert portion 33, so that the thickness of the protruding portion 10*a* of the mold inevitably becomes thin. Therefore, if the thin protruding portion 10*a* (hereinafter, referred to as a thin protrusion 10*a*) of the mold is heightened up to the height L1, a strength of the thin protrusion 10*a* is decreased, so that the thin protrusion 10*a* can be easily lost. Accordingly, there is somewhat limitation in the upward installation height of the temporary engagement portions 34.

On the contrary, similarly to the slider 1 according to the first embodiment, since the stepped portion 38 is disposed in the vicinity of the concave insert portion 33 (the case indicated by the solid line in FIG. 6), the height of the thin protrusion 10*a* for forming the cavity of the temporary engagement portions 34 can be set to be low as the dimension L2. Therefore, it is possible to stably secure the strength of the thin protrusion 10*a*, so that it is possible to prevent a loss from occurring in the mold. Accordingly, it is possible to easily form the temporary engagement portions 34 at a desired height. In addition, the life cycle of the mold is increased, so that it is possible to reduce the production cost of the slider 1.

In the slider 1 according to the first embodiment, the temporary engagement portions 34 are disposed upwardly from the bottom surface portion of the concave insert portion 33. After the locking pawl 6 is inserted into the insert groove 32 of the upper blade 21, temporary engagement is performed by bending the left and right temporary engagement portions 34 inwardly. Therefore, as illustrated in FIGS. 2 to 4, the other end portion of the locking pawl 6 can be temporarily engaged and fixed in the state where a predetermined clearance is provided between the inner surfaces of the front end portion of the temporary engagement portions 34 and the bottom surface of the insert groove 32.

In this case, in the temporary engagement portions 34 according to the first embodiment, in the state where the locking pawl 6 is temporarily engaged and fixed, the upper ends 34*a* of the temporary engagement portions 34 are disposed at the height positions equal to the same plane as the upper surface of the upper blade 21 or at the height positions lower than the upper surface. In other words, in the first embodiment, the temporary engagement portions 34 are disposed so that a height dimension H1 from the bottom surface portion of the concave insert portion 33 to the upper ends 34*a* of the temporary engagement portions 34 is equal to or smaller than a height dimension H2 from the bottom surface portion of the concave insert portion 33 to the upper surface of the upper blade 21.

In addition, in the state where the locking pawl 6 is temporarily engaged and fixed, the temporary engagement portions 34 is formed so that the upper ends 34*a* of the temporary engagement portions 34 are disposed at the positions higher than the stepped plane of the stepped portion 38. Therefore, when the other end portion of the locking pawl 6 is temporarily engaged and fixed by the temporary engagement portions 34, it is possible to stably secure a predetermined clearance so that the other end portion of the locking pawl 6 can be moved in the upward and downward directions between the inner surfaces of the front end portions of the temporary engagement portions 34 and the bottom surface of the insert groove 32.

The rising portions 35 are disposed to rise from the upper surface of the upper blade 21 on the left and right sides of the insert groove 32. If the rising portions 35 is disposed, for example, when the locking pawl 6 is disposed into the insert groove 32 and the locking pawl 6 is shaken upwards and downwards in the insert groove 32 by the manipulation of the tab 5, although a portion of the locking pawl 6 is moved up to a position higher than the upper surface of the upper blade 21, the locking pawl 6 can be hidden so as not to be easily seen from the left and right sides by the rising portions 35 so that the locking pawl 6 is not popped up from an inner portion of the insert groove 32. Therefore, it is possible to improve outer appearance of the slider 1.

In addition, when the tab 5 is attached to the slider body 2 and allowed to be fallen down to the side of the connection post 23 as described later, the rising portions 35 define the rotation limit of the tab 5 by contacting the tab 5. Therefore, although the tab 5 is completely fallen down to the side of the connection post 23, a gap occurs between the fallen tab 5 and the upper surface of the upper blade 21, so that it is possible to prevent the tab 5 from colliding with the temporary engagement portions 34.

The tab engagement portion 36 is disposed upwardly at the center of the upper surface of the upper blade 21 on the rear-opening-side end portion. The tab engagement portion 36 includes a neck portion 36*a* which is erected from the upper surface of the upper blade 21 and an engagement head 36*b* which is disposed on the upper end of the neck portion 36*a* and swollen with respect to the neck portion 36*a* in the leftward and rightward directions. In this case, the forward-backward-directional dimension of the engagement head 36*b* is set to be equal to that of the neck portion 36*a*. In addition, the upper surface of the engagement head 36*b* is to be flat, and the left and right side edges thereof are formed to be swollen out in an arc shape in the outer sides.

The tab 5 according to the first embodiment includes a tab body 51, left and right arms 52 which are disposed to extend from the one end of the tab body 51 in parallel to each other, and a connection rod 53 which connects the front end portions of the left and right arms 52. In addition, a rectangular opening window 54 penetrating the front-rear surface in the front-rear direction is formed in the central portion of the front-rear surface of the tab body 51, and left and right cantilever engagement pieces 55 are disposed to extend toward the side of the connection rod 53 from the side wall 54*a* disposed on the side of the other end portion of the tab 5 among the side walls surrounding the opening window 54.

Particularly, the left and right cantilever engagement pieces 55 include first engagement piece portions 55*a* which are disposed to extend from the base end sides toward the front end sides to be slanted with the distance therebetween shortened and second engagement piece portions 55*b* which are disposed to extend from the front ends of the first engagement piece portions 55*a* to be parallel to each other. In this case, the distance between the left and right second engagement piece portion 55*b* is set to be larger than the width dimension of the neck portion 36*a* of the tab engagement portion 36 disposed to the slider body 2 and to be smaller than the width dimension of the engagement head 36*b* of the tab engagement portion 36.

Figure 7:
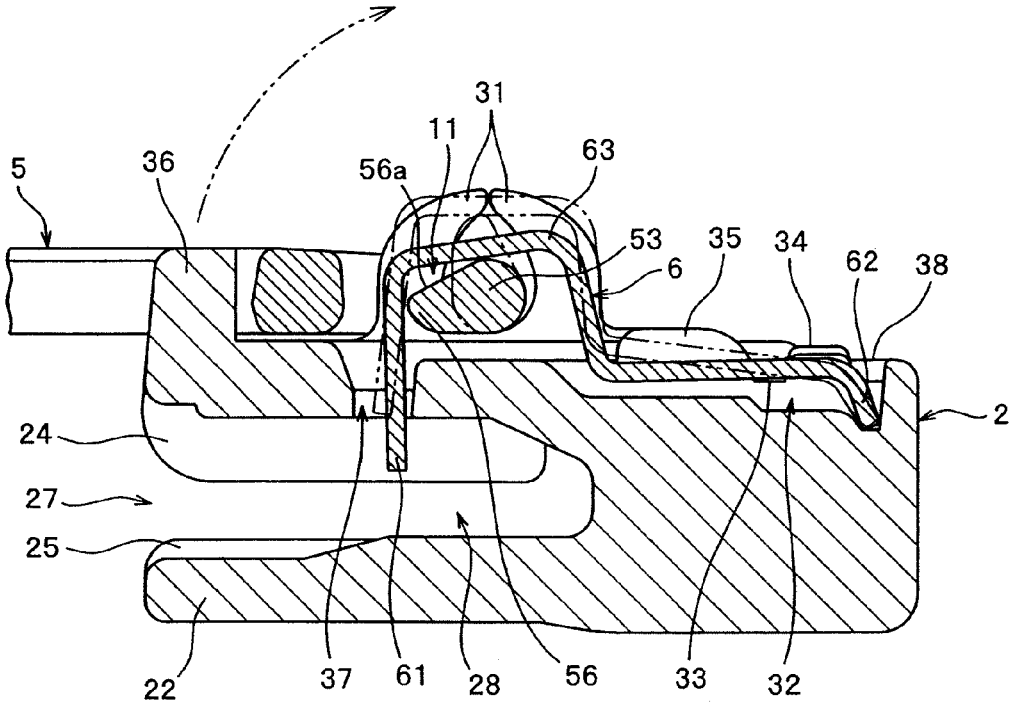
FIG. 7 is a cross-sectional view illustrating manipulation of erecting the tab from a state where the tab is fallen down to the rear opening side in the slider.

The connection rod 53 of the tab 5 is formed to be in a cylindrical shape having a circular cross section. In the central portion of the connection rod 53, a cam 56 is integrally disposed to protrude toward an inner portion of an opening constructed with the connection rod 53, the left and right arms 52, and the one end edge of the tab body 51. The cam 56 includes a slant surface 56*a*, which is slanted downwardly toward the front end of the cam, on the side of the first plane (surface) of the tab 5 so that the cross section area of the cam 56 perpendicular to the length direction of the tab is gradually decreased from the base end side of the cam 56 toward the front end side. Therefore, for example, as illustrated in FIG. 7, when the tab 5 is allowed to be completely fallen down on the side of the rear opening 27 with respect to the slider body 2, a predetermined gap 11 can be formed between the slant surface 56*a* of the cam 56 and a later-described cover portion 63 of the locking pawl 6.

In the locking pawl 6 according to the first embodiment, a claw portion 61 having elasticity which can be inserted into and detached from the element guide lane 28 through the claw hole 37 of the slider body 2 is provided to the one end portion thereof, and a hook portion 62 which is inserted into the insert groove 32 of the slider body 2 is provided to the other end portion. In addition, between the claw portion 61 and the hook portion 62 of the locking pawl 6, a cover portion 63 having a cross section in a substantially U shape is disposed to cover the connection rod 53 and the cam 56 of the tab 5 from the upper side.

The width dimension of the cover portion 63 of the locking pawl 6 is smaller than the interval between the left and right tab retaining portions 31 disposed on the slider body 2 and larger than the groove width of the insert groove 32 formed in the slider body 2. In addition, the width dimension of the portion of the other end side from the cover portion 63 of the locking pawl 6 is smaller than the groove width of the insert groove 32 formed in the slider body 2.

Next, a method of assembling the aforementioned slider 1 according to the first embodiment, which is constructed with the slider body 2, the tab 5, and the locking pawl 6 is described.

First, the connection rod 53 of the tab 5 is inserted between the forward and backward tab temporary-engagement protrusions 31*a* provided to the left and right tab retaining portions 31 of the slider body 2, and in the state where the tab 5 is fallen down to the side of the rear opening of the slider body 2, the temporary engagement is performed by bending the forward and backward tab temporary-engagement protrusions 31*a* in the approaching direction. Therefore, the tab 5 can be retained to be rotatable about the connection rod 53 with respect to the slider body 2.

Subsequently, in the slider body 2 retaining the tab 5, the locking pawl 6 is inserted into the insert groove 32 of the slider body 2 by allowing the claw portion 61 of the locking pawl 6 to pass through the claw hole 37 of the slider body 2 and allowing the cover portion 63 of the locking pawl 6 to cover the connection rod 53 and the cam 56 of the tab 5 from the upper side. Therefore, the locking pawl 6 is disposed at a predetermined position of the slider body 2.

After that, the temporary engagement is performed by bending the temporary engagement portions 34 disposed to the slider body 2 inwards, so that in the state where the claw portion 61 of the locking pawl 6 is allowed to pass through the claw hole 37, the other end portion of the locking pawl 6 is temporarily engaged and fixed with a predetermined clearance by the temporary engagement portions 34. The slider 1 for the slide fastener according to the first embodiment illustrated in FIGS. 2 to 4 can be assembled by performing such operations.

In this manner, in the slider 1 obtained according to the first embodiment, since the temporary engagement portions 34 are disposed upwardly from the bottom surface portion of the concave insert portion 33, in the state where the locking pawl 6 is temporarily engaged and fixed, the upper ends 34*a* of the temporary engagement portions 34 are disposed at the height position equal to that of the upper surface of the upper blade 21 or lower than the upper surface.

Therefore, the temporary engagement portions 34 are disposed at the position lower than the upper surface of the upper blade 21 in the state where the temporary engagement portions 34 are received in the concave insert portion 33 without protruding from the upper surface of the upper blade 21 similarly to the conventional slider 1. Accordingly, in the case where the slide fastener is configured by using the slider 1, since the temporary engagement portions 34 is prevented from being in contact with other members, it is possible to prevent the temporary engagement portions 34 from being pressed directly by an external force applied from the other member. As a result, where the other end portion of the locking pawl 6 is fixed, it is possible to stably maintain a size of the clearance provided in inner sides of the temporary engagement portions 34.

In addition, in the slider 1 according to the first embodiment, for example, as illustrated in FIGS. 2 and 3, by allowing the tab 5 to be fallen down to the side of the rear opening 27 of the slider body 2, the cam 56 formed on the connection rod 53 of the tab 5 is directed in the direction which is substantially parallel to the upper surface of the upper blade 21. At this time, since the cam 56 of the tab 5 does not interfere with the cover portion 63 of the locking pawl 6, the cover portion 63 of the locking pawl 6 is not lifted up by the cam 56, and the claw portion 61 of the locking pawl 6 is in the state where it protrudes toward an inner portion of the element guide lane 28 through the claw hole 37.

Accordingly, in the case where a slide fastener is configured by passing the slider 1 according to the first embodiment between the element rows of the fastener chain, by allowing the tab 5 to be fallen down to the side of the rear opening 27 of the slider body 2, the claw portion 61 of the locking pawl 6 protrudes toward the inner portion of the element guide lane 28 to be engaged with the element rows, the locked position of the slider 1 with respect to the element rows can be maintained.

In addition, in this manner, in the case where the tab 5 is allowed to be fallen down to the side of the rear opening 27 of the slider body 2, by pressing the tab 5 toward the tab engagement portion 36 disposed on the slider body 2, the left and right cantilever engagement pieces 55 disposed in the tab 5 are bent in the outer sides to override the engagement head 36*b* of the tab engagement portion 36, so that cantilever engagement pieces 55 are engaged with the tab engagement portion 36 of the slider body 2, for example, as illustrated in FIGS. 2, 3, and 5.

In this manner, by engaging the cantilever engagement pieces 55 of the tab 5 with the tab engagement portion 36 of the slider body 2, the tab 5 can be retained in the fallen state. Therefore, the state where the claw portion 61 of the locking pawl 6 is allowed to protrude toward the inner portion of the element guide lane 28 and engaged with the element rows is stably maintained, so that the slider 1 can be securely maintained at the locked position. In addition, the engaged state between the cantilever engagement pieces 55 of the tab 5 and the tab engagement portion 36 of the slider body 2 can be easily released by rotating the tab 5 in the direction of being separated from the upper blade 21.

In addition, in the slider 1 according to the first embodiment, the cam 56 of the tab 5 includes the downward slant surface 56*a* as described above. Therefore, for example, in the case where the cantilever engagement pieces 55 of the tab 5 are not engaged with the tab engagement portion 36 of the slider body 2, although the tab 5 is mounted on the tab engagement portion 36 to be in the slanted state with respect to the upper surface of the upper blade 21, the cam 56 of the tab 5 does not interfere with the cover portion 63 of the locking pawl 6, and the claw portion 61 of the locking pawl 6 is allowed to protrude toward the inner portion of the element guide lane 28 so as to be engaged with the element rows.

In addition, therefore, for example, even in the case where the tab 5 is slightly lifted up in order to release the state where the tab 5 is engaged with the tab engagement portion 36, if the tab 5 is moved within an range where the cam 56 of the tab 5 does not interfere with the cover portion 63 of the locking pawl 6, the claw portion 61 of the locking pawl 6 is not detached from the element guide lane 28, and the engaged state of the tab 5 can be released in the state where the slider 1 is maintained at the locked position.

Figure 8:
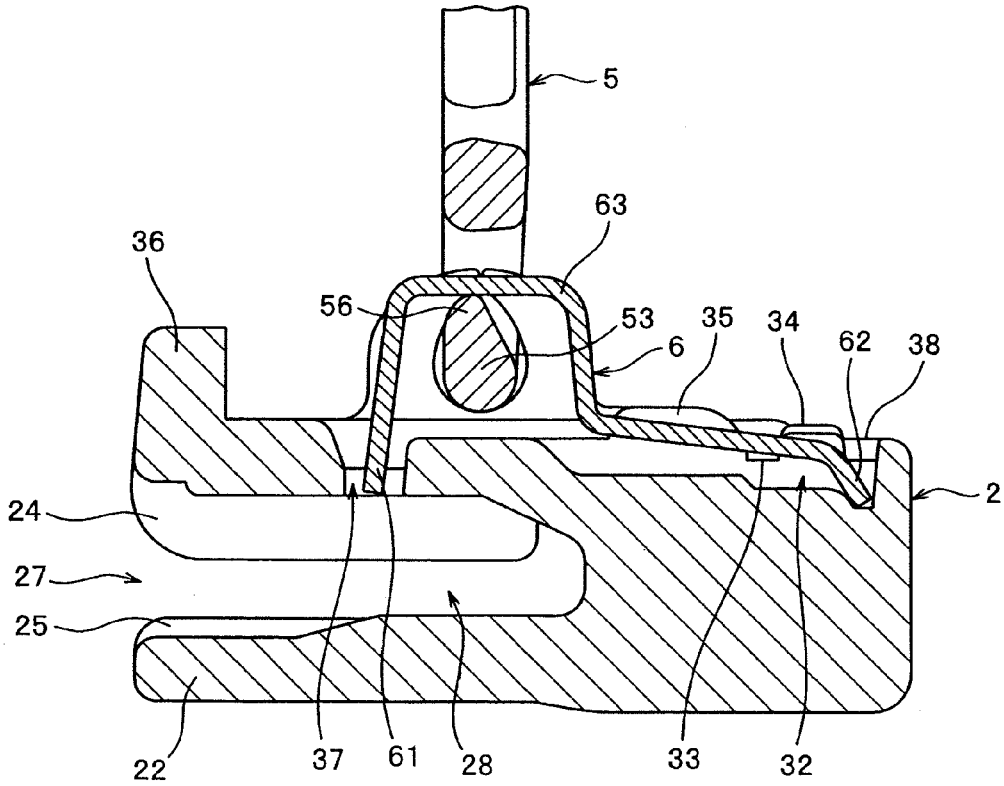
FIG. 8 is a cross-sectional view illustrating a state where the tab is erected in the slider.

On the other hand, in the slider 1 according to the first embodiment, in the case where the tab 5 is lifted up to be erected in the direction of straightly directing with respect to the upper blade 21 from the state where the tab 5 is fallen down to the side of the rear opening 27 of the slider body 2 as illustrated in FIG. 7, by slanting the tab 5 in an angle exceeding a predetermined slant angle with respect to the upper surface of the upper blade 21, the cam 56 of the tab 5 interferes with the cover portion 63 of the locking pawl 6, so that the locking pawl 6 can be lifted up by the cam 56. As a result, the claw portion 61 of the locking pawl 6 can be detached from the element guide lane 28 (refer to FIG. 8)

At this time, since the other end portion of the locking pawl 6 is temporarily engaged and fixed by the temporary engagement portions 34 with a predetermined clearance, the locking pawl 6 can be easily bent in the insert groove 32 by using the clearance, so that the detaching operation of the claw portion 61 can be smoothly performed.

Figure 9:
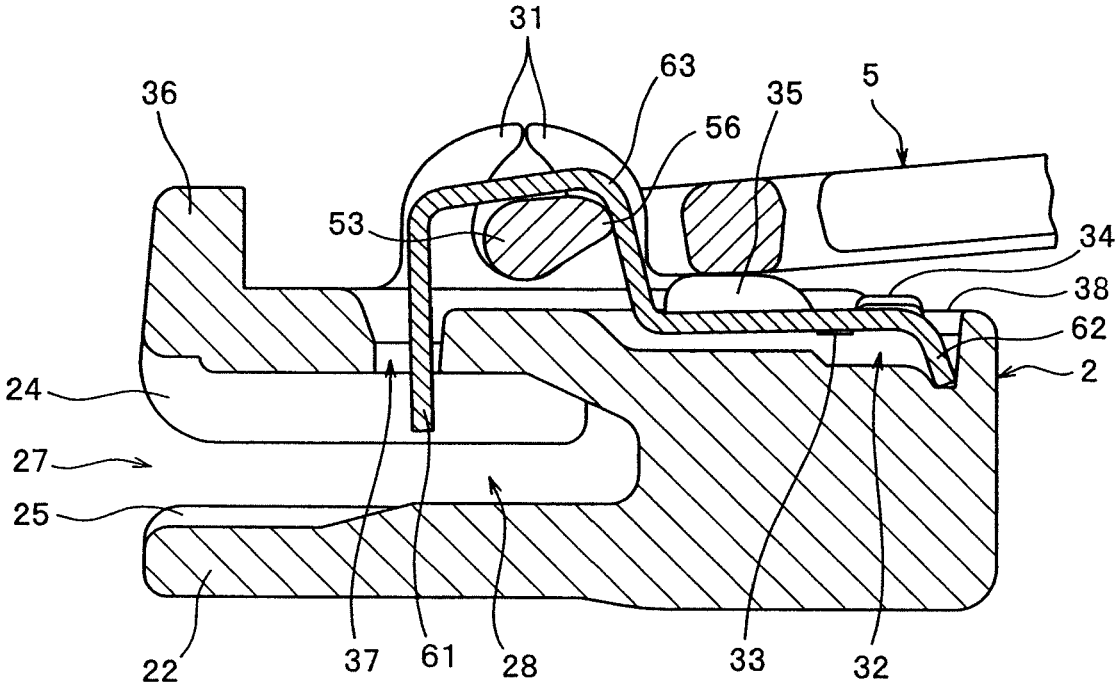
FIG. 9 is a cross-sectional view illustrating a state where the tab is fallen down to a connection post side in the slider.

In addition, in the slider 1 according to the first embodiment, by allowing the tab 5 to be fallen down to the side of the connection post 23 from the erected state, the cam 56 of the tab 5 does not interfere with the cover portion 63 of the locking pawl 6. Therefore, as illustrated in FIG. 9, the cover portion 63 of the locking pawl 6 is lifted down, so that the claw portion 61 is allowed to protrude toward the inner portion of the element guide lane 28 and engaged with the element rows. Therefore, the slider 1 can be retained at the locked position.

At this time, since the rising portions 35 are disposed between the tab retaining portion 31 and the concave insert portion 33 of the upper blade 21, the state where the tab 5 is in contact with the rising portions 35 becomes the state where the tab 5 is completely fallen down to the side of the connection post 23. In addition, since a gap is formed between the tab 5 and the upper surface of the upper blade 21, although the tab 5 is completely fallen down to the side of the connection post 23, the tab 5 cannot contact with the temporary engagement portions 34 of the slider body 2. Accordingly, in the slider 1 according to the first embodiment, the temporary engagement portions 34 are not pressed by an external force applied from the tab 5 similarly to the conventional technology, and it is possible to stably maintain a size of the clearance provided to inner sides of the temporary engagement portions 34.

In this manner, in the slider 1 having an automatic locking mechanism according to the first embodiment, it is possible to prevent the temporary engagement portions 34 allowing the locking pawl 6 to be temporarily engaged and fixed from being pressed by an external force applied due to the contact with the tab 5 or other members.

Accordingly, in the slider 1, a size of the clearance provided in inner sides of the temporary engagement portions 34 can be stably maintained for a long time, so that the inserting and detaching operations of the claw portion 61 with respect to the element guide lane 28 can be smoothly performed. Therefore, it is possible to allow the automatic locking mechanism of the slider 1 to stably function. In addition, at the time of sliding the slider 1, the sliding property of the slider 1 cannot be deteriorated without protruding the claw portion 61 toward the inner portion of the element guide lane 28.

In addition, similarly to the first embodiment, the slider 1 is configured by providing the concave insert portion 33 and disposing the temporary engagement portions 34 upwardly from the bottom surface portion of the concave insert portion 33, so that it is possible to reduce the cost of components in comparison with the conventional slider 1 where the temporary engagement portions 34 is disposed upwardly from the upper surface of the upper blade 21, Therefore, it is possible to reduce the cost of the slider 1.

Second Embodiment

Figure 10:
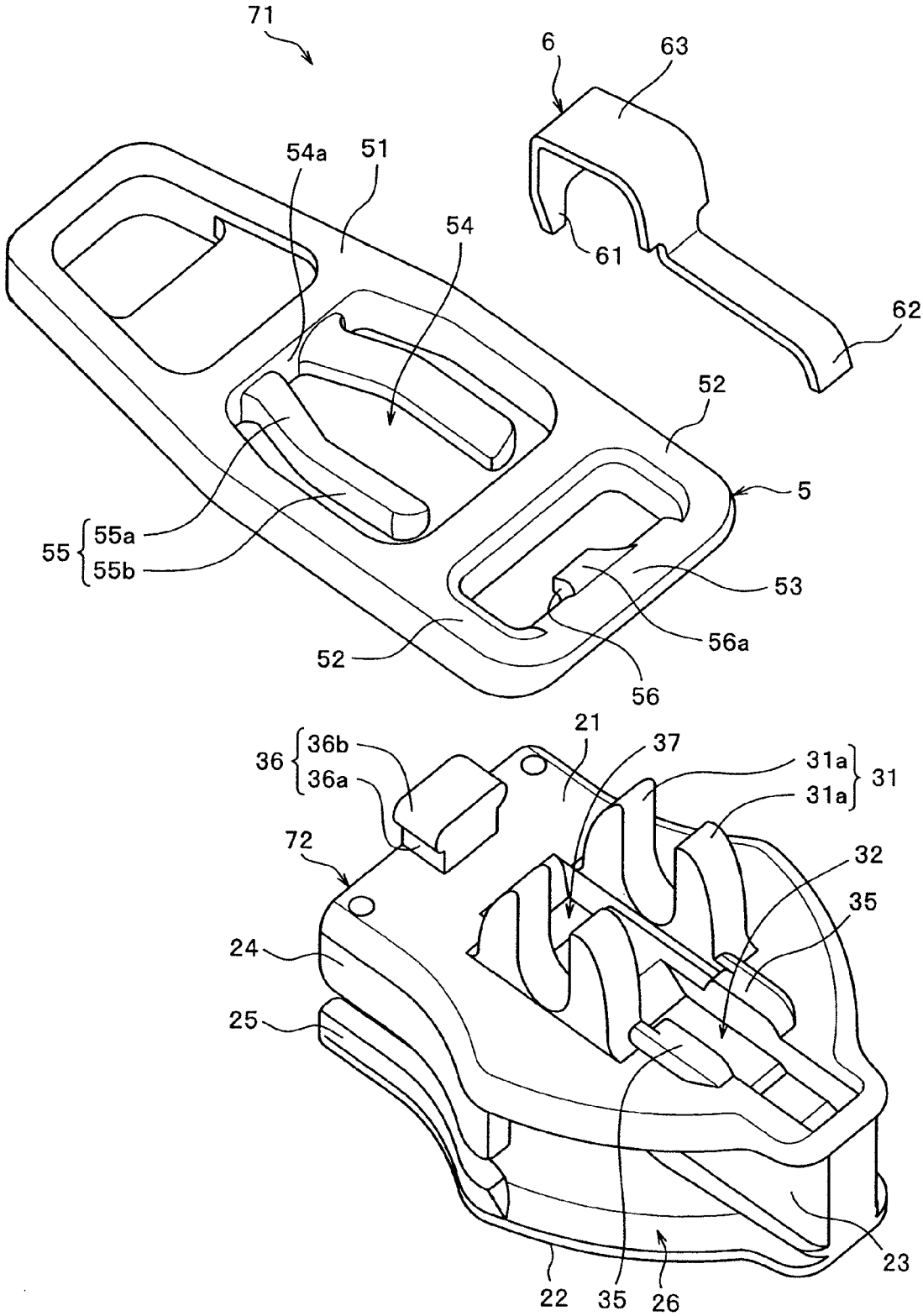
FIG. 10 is a perspective view illustrating a state where parts constituting a slider for a slide fastener according to a second embodiment are separated.
Figure 11:
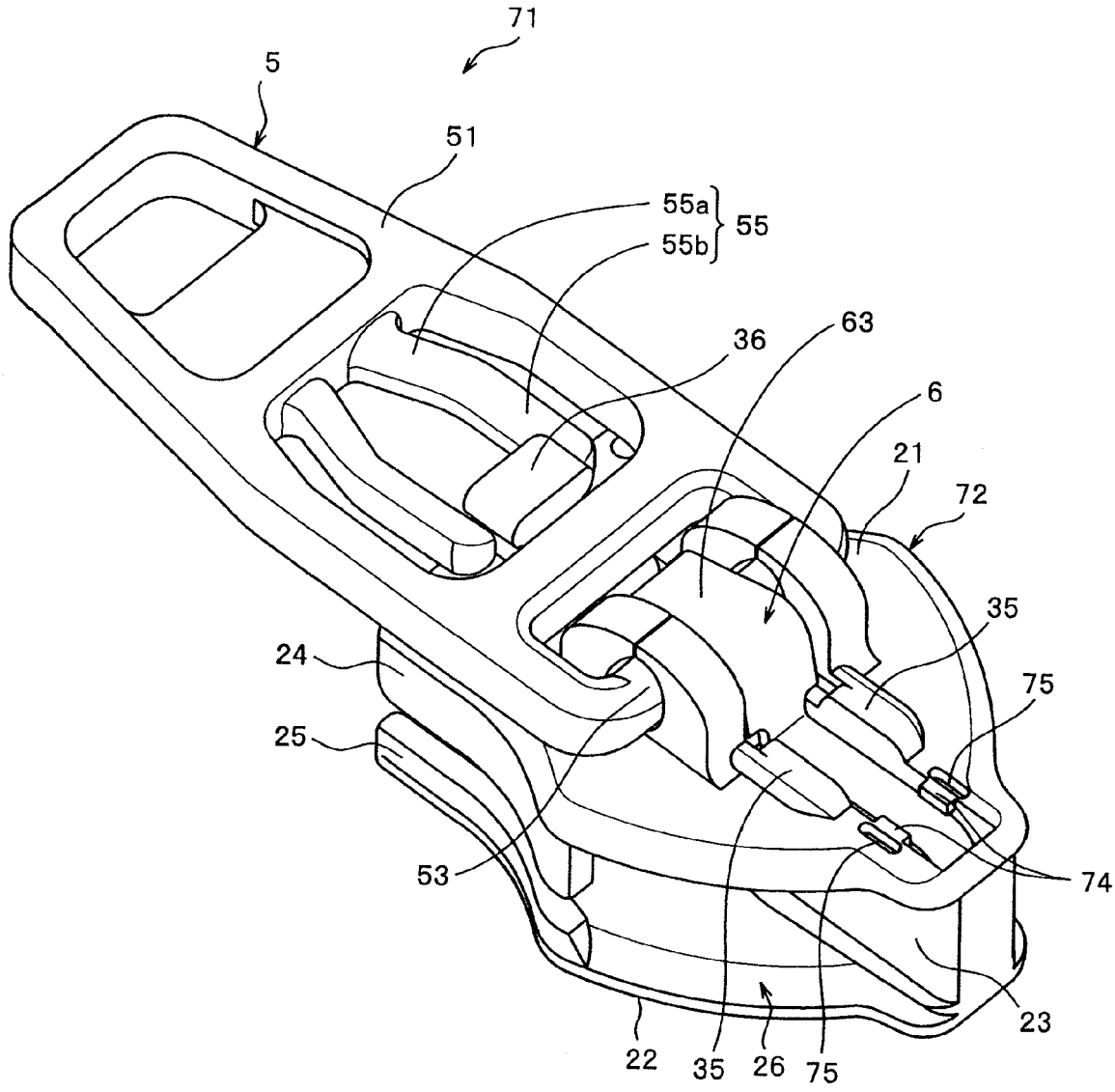
FIG. 11 is a perspective view illustrating a state where the slider is assembled.
Figure 12:
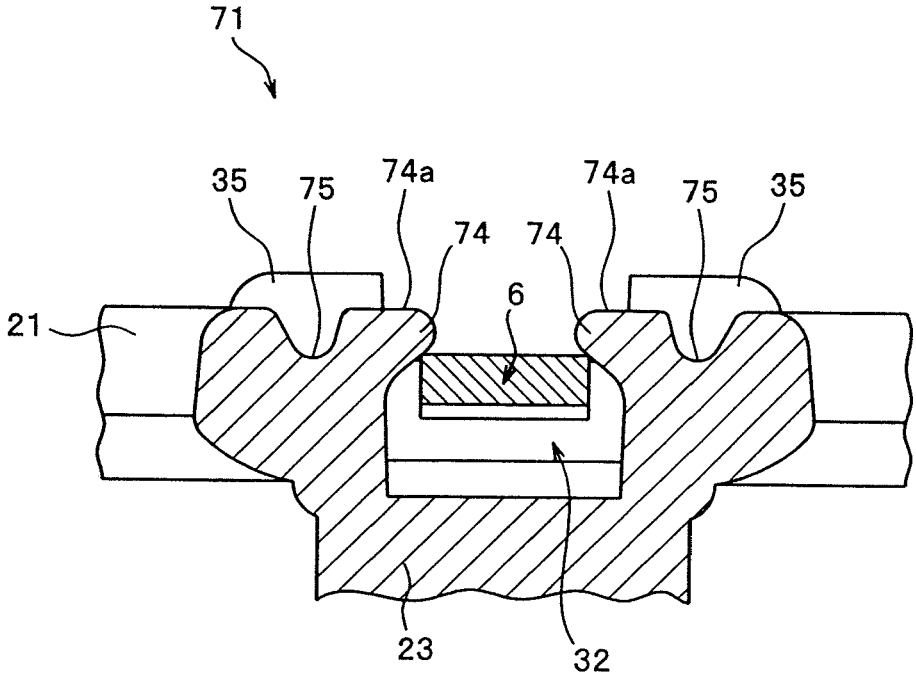
FIG. 12 is a cross-sectional view illustrating a portion where a temporary engagement portion of the slider is disposed.
Figure 13:
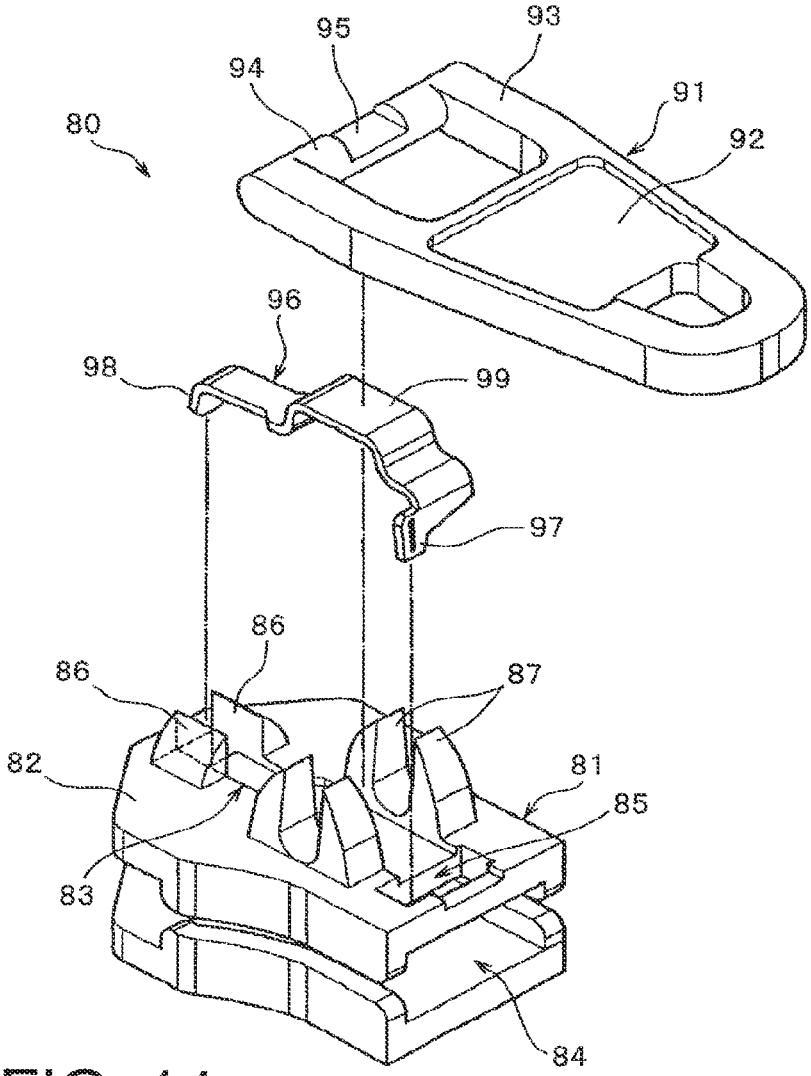
FIG. 13 is a perspective view illustrating a state where parts constituting a conventional slider are separated.
Figure 14:
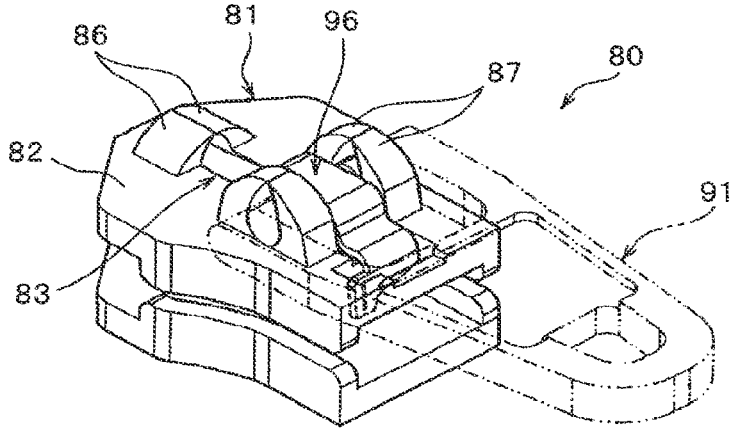
FIG. 14 is a perspective view illustrating a state where the conventional slider is assembled.

FIG. 10 is a perspective view illustrating a state where parts constituting a slider for a slide fastener according to a second embodiment are separated, and FIG. 11 is a perspective view illustrating a state where the slider is assembled. In addition, FIG. 12 is a cross-sectional view illustrating a portion where a temporary engagement portion of the slider is disposed.

The slider 71 for a slide fastener according to the second embodiment is different from the slider 1 according to the first embodiment in terms of the shape of the temporary engagement portions 74 which temporarily engage and fix the locking pawl 6. Except for the front end portion of the upper blade 21 where the temporary engagement portions 74 are disposed, the other components are substantially the same as those of the slider 1 according to the first embodiment. Accordingly, in the second embodiment, the parts and elements having the same configurations as those of the slider 1 according to the first embodiment are denoted by the same reference numerals, and thus, the description of the parts and the elements is omitted.

In the slider 71 according to the second embodiment, as illustrated in FIG. 10, the upper blade 21 where the locking pawl 6 is not yet temporarily engaged and fixed includes the left and right tab retaining portions 31, the insert groove 32 of the locking pawl 6, the rising portions 35 which are disposed at the left and right sides of the insert groove 32, and the tab engagement portion 36 which is disposed upwardly on the side end portion of the rear opening 27 of the upper blade 21. The upper blade 21 does not include the concave insert portion 33 and a pair of the left and right temporary engagement portions 34 which are disposed upwardly from the bottom surface portion of the concave insert portion 33 unlike the slider 1 according to the first embodiment.

In the case of assembling the slider 71 according to the second embodiment by attaching the tab 5 and the locking pawl 6 to the slider body 72, first, similarly to the first embodiment, the tab 5 is inserted into the left and right tab retaining portions 31 of the slider body 2, and the tab retaining portions 31 are temporarily engaged, so that the tab 5 can be rotatably retained with respect to the slider body 2.

Subsequently, in the slider body 2 retaining the tab 5, the locking pawl 6 is inserted into the insert groove 32 of the slider body 2 by allowing the claw portion 61 of the locking pawl 6 to pass through the claw hole 37 of the slider body 2 and allowing the cover portion 63 of the locking pawl 6 to cover the connection rod 53 and the cam 56 of the tab 5 from the upper side. Therefore, the locking pawl 6 is disposed at a predetermined position of the slider body 2.

After that, in the front end portion of the upper blade 21, by locally pressing the left and right side portions in the vicinity of the insert groove 32 of the upper surface of the upper blade 21 from the upper side, as illustrated in FIGS. 11 and 12, a portion of the upper blade 21 is plastically deformed so as to be projected from the side wall of the insert groove 32 toward an inner portion of the insert groove 32. Therefore, a concave portion 75 is formed on the upper surface of the upper blade 21 by the pressing, and the temporary engagement portions 74 can be disposed to extend toward an inner portion of the insert groove 32, so that the other end portion of the locking pawl 6 can be temporarily engaged and fixed by the temporary engagement portions 74 with a predetermined clearance. By performing the hereinbefore assembling operation, the slider 71 for a slide fastener according to the second embodiment illustrated in FIG. 11 can be assembled.

In the slider 71 according to the second embodiment, similarly to the first embodiment, in the state where the locking pawl 6 is temporarily engaged and fixed, the upper ends 74*a* of the temporary engagement portions 74 are disposed at the height position equal to that of the upper surface of the upper blade 21 or at the height position lower than that of the upper surface. Accordingly, it is possible to prevent the temporary engagement portions 74 which temporarily engage and fix the locking pawl 6 from being pressed due to the contact with the tab 5 or the other members, so that it is possible to stably maintain a size of the clearance provided to inner sides of the temporary engagement portions 74 for a long time. Therefore, in the slider 71, the inserting and detaching operations of the claw portion 61 with respect to the element guide lane 28 can be smoothly performed, so that it is possible to allow the automatic locking mechanism of the slider 71 to stably function, and it is possible to prevent the sliding property of the slider 71 from being deteriorated.

In addition, in the slider 71 according to the second embodiment, in comparison with the slider 1 according to the first embodiment, since the temporary engagement and fixing of the locking pawl 6 by the temporary engagement portions 74 can be easily performed, so that it is possible to improve the assembling property of the slider 71.

The invention claimed is:

1. A slider for a slide fastener comprising:

a slider body, in which front end portions of upper and lower blades are connected to each other by a connection post and a Y-shaped element guide lane is disposed between the upper and lower blades;

a tab whose one end portion is rotatably retained in the upper blade; and a locking pawl which is disposed in the upper blade and whose one end is provided with a claw portion, the slider body including an insert groove which is disposed in a concave shape from an upper surface of the upper blade and into which the locking pawl is inserted, a temporary engagement portion which is disposed on the front end portion of the upper blade and fixes an other end portion of the locking pawl, and a claw hole which is penetrated so as to receive the claw portion, wherein a tab retaining portion which rotatably retains the tab is disposed to protrude from the upper surface of the upper blade, wherein the locking pawl is disposed so that the claw portion can be inserted into and detached from the element guide lane through the claw hole by falling and erecting operations of the tab, wherein in a state where the locking pawl is fixed, the temporary engagement portion is disposed so that a height position of an upper end of the temporary engagement portion is equal to that of the upper surface of the upper blade or lower than that of the upper surface.

2. The slider for the slide fastener according to claim 1, wherein a concave insert portion is disposed in a concave shape on left and right sides of the insert groove on a side of an upper surface of a portion, which is connected to the connection post of the upper blade, and the temporary engagement portion is disposed upwardly from a bottom surface portion of the concave insert portion.

3. The slider for the slide fastener according to claim 2, wherein a stepped portion which is formed at a height position between the upper surface of the upper blade and the bottom surface portion of the concave insert portion is provided to at least a portion of a circumference of the concave insert portion.

4. The slider for the slide fastener according to claim 1, wherein the temporary engagement portion allows the upper blade to be pressed from the upper surface and allows a portion of the upper blade to be plastically deformed, so that the temporary engagement portion is disposed to extend so as to be projected from a side wall of the insert groove toward an inner portion of the insert groove.

5. The slider for the slide fastener according to claim 1, wherein rising portions which rise from the upper surface of the upper blade and allow the tab to contact with the rising portions when the tab is fallen down to a side of the connection post are disposed between the temporary engagement portion and the tab retaining portion.

6. The slider for the slide fastener according to claim 5, wherein the rising portions are disposed at left and right sides of the insert groove.

* * * * *

UNITED STATES PATENT AND TRADEMARK OFFICE

CERTIFICATE OF CORRECTION

PATENT NO. : 8,584,326 B2
APPLICATION NO. : 13/126048
DATED : November 19, 2013
INVENTOR(S) : Keiichi Keyaki et al.

It is certified that error appears in the above-identified patent and that said Letters Patent is hereby corrected as shown below:

In the Specification

In column 8, line 9, Delete “a the” and insert -- a --, therefor.

In column 8, line 10, Delete “a the” and insert -- a --, therefor.

In column 13, line 54, After “8)” insert -- . --.

Signed and Sealed this
Fourth Day of March, 2014

Michelle K. Lee

Michelle K. Lee
*Deputy Director of the United States Patent and Trademark Office*